United States Patent [19]

Spitaler et al.

[11] Patent Number: 4,688,820

[45] Date of Patent: Aug. 25, 1987

[54] APPARATUS FOR HOLDING SKIS TOGETHER

[75] Inventors: Engelbert Spitaler, Wr. Neudorf; Hubert Wuerthner, Hainburg, both of Austria

[73] Assignee: TMC Corporation, Baar, Switzerland

[21] Appl. No.: 828,952

[22] Filed: Feb. 12, 1986

[30] Foreign Application Priority Data

Feb. 15, 1985 [AT] Austria ..... 450/85

[51] Int. Cl.[4] ..... A63C 7/10

[52] U.S. Cl. ..... 280/605

[58] Field of Search ..... 280/604, 605, 814, 816

[56] References Cited

U.S. PATENT DOCUMENTS 4,181,321 1/1980 Riedel ..... 280/605
4,350,364 9/1982 Salomon ..... 280/605

FOREIGN PATENT DOCUMENTS 317746 12/1973 Austria .
371008 10/1982 Austria .
2806643 8/1979 Fed. Rep. of Germany ..... 280/605

*Primary Examiner*—John J. Love
*Assistant Examiner*—Richard Camby
*Attorney, Agent, or Firm*—Flynn, Thiel, Boutell & Tanis

[57] ABSTRACT

The ski brake blades of the present invention have a recess or notch on their inner surface. These notches engage the mandrels of the other ski brake at a point above the blade. The two skis are thus held together.

5 Claims, 3 Drawing Figures

APPARATUS FOR HOLDING SKIS TOGETHER

FIELD OF THE INVENTION

The invention relates to an apparatus for holding a pair of skis together, which skis are equipped with ski brakes, in which each is provided with braking blades which are made of plastic or the like and which have a recess in the form of a transversely extending groove.

BACKGROUND OF THE INVENTION

Such an apparatus is described in Swiss Pat. No. 591,263. The braking blades are, in this apparatus, arranged approximately in its central portion of the blades, namely in the case of the braking blades of one ski brake on its inwardly facing side and in the case of the braking blades of the other ski brake on its outwardly facing side. In the held-together position of the two skis, the braking blades are crossed, and the recesses engage one another to form a locking engagement.

A further embodiment of an apparatus for holding a pair of skis together can be taken from a brochure of the Firm Look 1978/79, which was distributed at the ISPO 1978. The braking blades, which are made of plastic, are in this design injection molded onto the end regions of wire sections of the individual braking arms, which wire sections are constructed as braking mandrels, and do not have any recesses. Rather, the pair of skis are held together in such a manner that the two crossing braking mandrels of the ski brakes on two oppositely facing skis are hooked together by their wire sections resting on one another on the shoulders of the individual plastic blades.

The known apparatus have the disadvantage that it will depend on the length of the braking mandrels and on the length of the braking blades, how and where the hooking together can occur. This, however, brings about certain problems during the construction of the ski brakes, since the braking mandrels, in the nonbraking position of the braking mechanism, lie above the upper side of the ski and within the lateral edges of the ski.

The invention has the purpose to overcome the disadvantages of the known designs by providing an apparatus for holding skis together and which skis are provided with ski brakes, the apparatus being independent of the length of the braking mandrel or the braking blades.

The aforementioned purpose is inventively attained by locating the notch in each braking blade adjacent an end of the braking blade remote from the braking mandrel. Due to the fact that during a clamping together of the two skis with the inventive apparatus, a certain shifting of one ski relative to the other in its longitudinal direction occurs (this results from the inventive construction), the designer has here a greater freedom than has been the case in the known apparatus.

BRIEF DESCRIPTION OF THE DRAWINGS

Two exemplary embodiments of the inventive apparatus are illustrated in a hooked-together condition in the drawings. More specifically.

DETAILED DESCRIPTION

Figure 1:
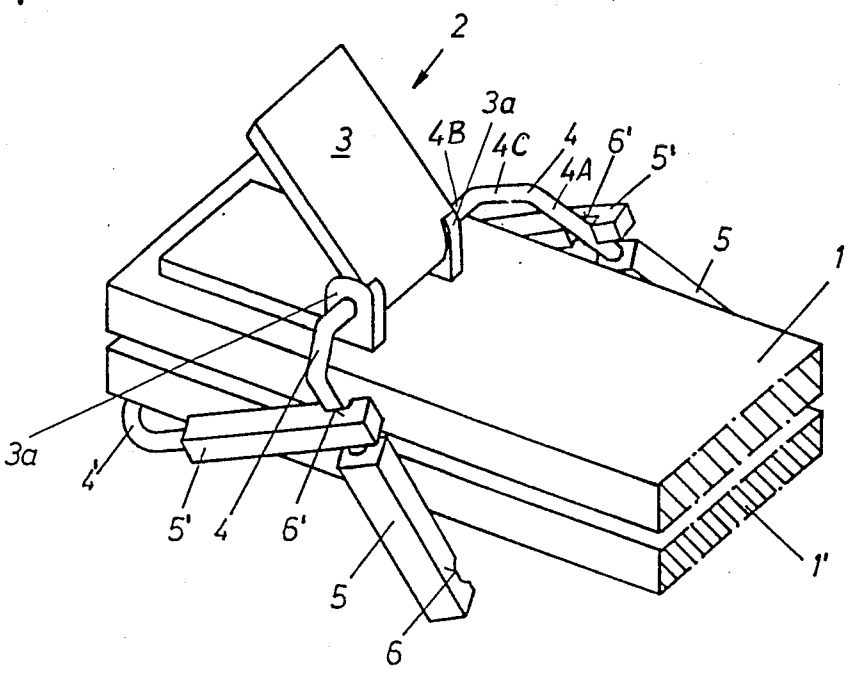
FIG. 1 is a perspective view of a first embodiment of the inventive apparatus.

The individual skis of a pair of skis are identified by the reference numerals 1 and 1'. Each ski has a ski brake 2 or 2' mounted thereon by conventional devices, as by not illustrated screws. Each ski brake is of a common construction and, therefore, is not discussed in detail. The braking mechanism of each ski brake 2 or 2' consists of a pedal 3 or 3' and two braking mandrels 4 or 4', which are manufactured of a spring steel wire. A braking blade 5 or 5' made of plastic is injection molded onto each wire braking mandrel 4 or 4'. A notch or recess 6 or 6' is provided at the end region of each braking blade remote from the braking mandrel. Each notch is in the form of an inwardly facing groove, the length of which extends transversely of the length of each blade. Each notch is also open at the opposite ends thereof.

Figure 2:
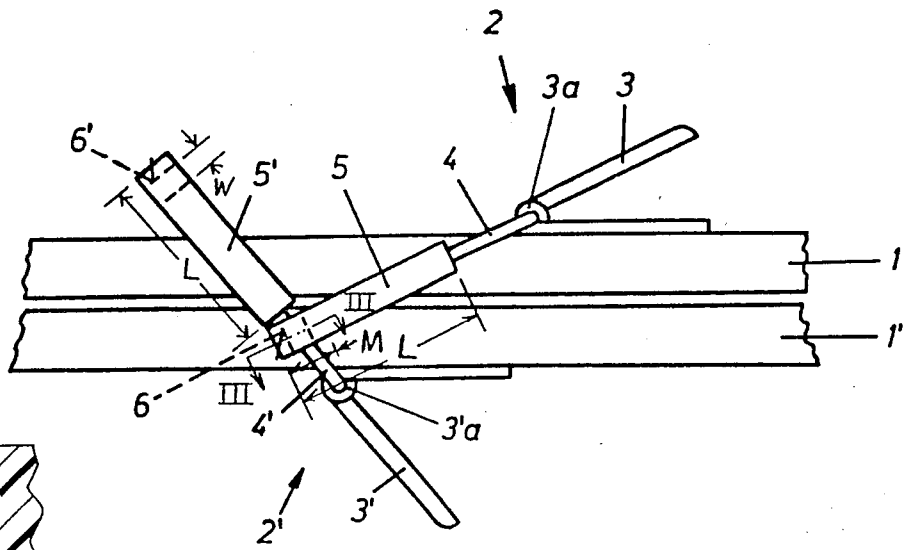
FIG. 2 is a side elevational view of a second embodiment of the inventive apparatus.
Figure 3:
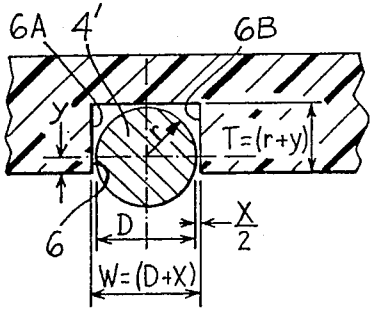
FIG. 3 is a sectional view taken along the line III—III of FIG. 2.

As shown in FIG. 2, each braking blade 5 or 5' has a longitudinal length L. The width W of the notch 6 or 6' is slightly greater than the diameter D of the braking mandrel 4 or 4' (see FIG. 3). The depth of the notch T is slightly greater than the radius r of the braking mandrel 4 or 4'. More specifically, and referring to FIG. 3, the two side walls 6A and 6B of the notch 6 are spaced from the outside diameter D of the braking mandrel 4' by the distance X/2. Thus, $W=D+x$. The depth T of the notch 6 is deeper than the radius r of the braking mandrel 4' by a distance y so that $T=r+y$. Further, the location of each notch 6 or 6' along the length of the braking blade is within distance M which is $\frac{1}{4}$ to $\frac{1}{3}$ the length L from the free end, namely, that end remote from the braking mandrel.

If now the two skis 1 and 1' of a pair of skis, as shown in FIG. 1, are hooked or connected together, then one ski 1' is first shifted approximately 1–2 cm. in the longitudinal direction thereof relative to the other ski 1. This causes the notches 6' in the braking blades 5' on the shifted ski 1' to receive directly therein the braking mandrels 4 on the other ski, namely, that portion of the mandrels 4 intermediate the braking blades 5 and the pedal 3. A locking engagement is thus created.

If now the hooking together of the two skis 1 and 1' is to be released, then the two braking mandrels 4' of the one ski 1' are manually urged outwardly against the force of their own elasticity until the recesses 6' on the braking blades 5' become disengaged from the braking mandrels 4 of the other ski. In this manner, the two skis 1 and 1' are separated from one another.

In the embodiment according to FIG. 2, the reversed position is illustrated, namely, the notches 6 of the braking blades 5 on the ski 1 receive therein the braking mandrels 4' of the other ski 1'. Otherwise, the manner of use corresponds with the embodiment according to FIG. 1.

For a better handling, the two braking mandrels 4 or 4', as is illustrated only on the mandrels 4 in FIG. 1, each have a horizontal axle portion 4B and a section 4C that is inclined to the axle portion at an angle of 45°. The inclined section 4C is positioned intermediate the axle portion 4B and the mandrel segment 4A on which the braking blades are mounted. However, they can also be arcuately bent.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a combination of a pair of ski braking means, one on each of a pair of skis having mutually facing running surfaces, both of said ski breaking means having:

a pair of braking mandrels straddling said ski;

support means, including an axle segment interconnecting said braking mandrels, causing them to move in unison, for pivotally securing said braking mandrels to a surface of said ski remote from the running surface thereof; and braking blades having an inner and outer surface of a certain width secured to the free end of said braking mandrels and which extend beyond a plane containing said running surface;

the improvement comprising wherein a notch is provided on each braking blade at a location beyond said plane, each of said notches opening inwardly of a respective one of said braking blades so that each notch faces a notch in the other braking blade when one of the two skis is not present therebetween, each notch being of a uniform depth of a width less then that of said outer surface of said braking blade and means orienting a pair of facing notches on said braking blades of one of said ski braking means with a respective one of a pair of braking mandrels on the other of said ski braking means when said one of the two skis is present therebetween and causing the pair of braking mandrels to enter said facing notches so that a majority of the cross sectional area of each braking mandrel occupies a majority of the cross sectional area of the notch in which it is received to effect a holding of said pair of skis together.

2. An apparatus according to claim 1, wherein between the braking blades of each ski braking means and said axle segment there is provided a sloped segment inclined at an angle of approximately 45° to the longitudinal axes of the axle segment and the braking mandrels.

3. An apparatus according to claim 1, wherein said braking blades are each injection molded onto the braking mandrels, said notch in each braking blade having a width slightly greater than the diameter of said braking mandrel and a depth slightly greater than the radius of said braking mandrel.

4. An apparatus according to claim 1, wherein said notch in each braking blade is located within a region from a free end of said braking blade that is less than $\frac{1}{3}$ the length of said braking blade.

5. An apparatus according to claim 1, wherein said notch in each braking blade is located within a region from a free end of said braking blade that is less than $\frac{1}{4}$ the length of said braking blade.

* * * * *